US005657816A

United States Patent [19]

Harada et al.

[11] Patent Number: 5,657,816

[45] Date of Patent: Aug. 19, 1997

[54] METHOD FOR REGULATING FLOW OF MOLTEN STEEL WITHIN MOLD BY UTILIZING DIRECT CURRENT MAGNETIC FIELD

[75] Inventors: Hiroshi Harada; Eiichi Takeuchi; Takehiko Toh, all of Futtsu; Takanobu Ishii, Tokai, all of Japan

[73] Assignee: Nippon Steel Corporation, Tokyo, Japan

[21] Appl. No.: 549,735

[22] PCT Filed: Mar. 29, 1994

[86] PCT No.: PCT/JP94/00513

§ 371 Date: Feb. 23, 1996

§ 102(e) Date: Feb. 23, 1996

[87] PCT Pub. No.: WO95/26243

PCT Pub. Date: Oct. 5, 1995

[51] Int. Cl.[6] ..... B22D 27/02

[52] U.S. Cl. ..... 164/466; 164/502

[58] Field of Search ..... 164/466, 502, 164/498, 147.1

[56] References Cited

U.S. PATENT DOCUMENTS 5,381,857 1/1995 Tozawa et al. ..... 164/502

*Primary Examiner*—Kuang Y. Lin

*Attorney, Agent, or Firm*—Pollock, Vande Sande & Priddy

[57] ABSTRACT

The present invention provides a method, for regulating the flow of a molten steel within a mold by taking advantage of a direct current magnetic field, comprising the step of carrying out continuous casting while regulating the flow of a molten steel, delivered through a nozzle, by applying a direct current magnetic field having a substantially uniform magnetic flux distribution over the whole width direction of the mold, characterized in that the flow velocity of a meniscus on the surface of the molten steel within the mold is regulated in a range of from 0.20 to 0.40 m/sec by regulating the molten steel delivery angle of the nozzle, the position of the magnetic field, and the magnetic flux density. When the flow velocity of the meniscus is greatly increased, a stream of the molten steel delivered through the nozzle is allowed to collide directly with a short-side wall of the mold and, thereafter, the flow velocity is regulated according to the following equation (1), while, when the flow velocity of the meniscus is increased or decreased, a stream of the molten steel delivered through the nozzle is allowed to traverse a magnetic field zone and then to collide with a short-side wall of the mold and, thereafter, the flow velocity is regulated according to the following equation (2):

$$V_P/V_O=1+\alpha_1\{1-\exp(-\beta_1\cdot H^2)\} \quad (1)$$

$$V_P/V_O=1+\alpha_2\{\sin(\beta_2\cdot H)\exp(-r\cdot H)\} \quad (2)$$

wherein $H=185.8\cdot B^2\cdot D\cdot T/(D+T)V$.

6 Claims, 9 Drawing Sheets

Listing of Reference Numeral of Drawings

1 ... mold
2 ... iron core
3 ... leg
4 ... coil
5 ... nozzle
6 ... magnetic field zone
7 ... molten steel stream delivered through nozzle
8 ... meniscus flow

Fig. 14

METHOD FOR REGULATING FLOW OF MOLTEN STEEL WITHIN MOLD BY UTILIZING DIRECT CURRENT MAGNETIC FIELD

DESCRIPTION

1. Technical Field

The present invention relates to a continuous casting method wherein a direct current magnetic field is applied to the direction of thickness of the mold over the whole width direction to make the molten steel stream uniform, and particularly to a continuous casting method wherein the meniscus flow velocity within the mold is regulated to a specified range.

2. Background Art

It is known that, in continuous casting, the flow of a molten steel within a mold greatly influences the quality of cast slabs and the operation. Specifically, the flow of a molten steel stream delivered through a nozzle brings slag inclusions, included in the molten steel, into a deep portion of a strand pool. The deeper the portion into which the inclusions are brought, the easier the trapping of the inclusions in a solidified shell and, hence, the higher the possibility of occurrence of defects in a cast slab. For this reason, the depth of the entry of a descending stream should be preferably as small as possible. On the other hand, regarding the surface of a molten steel, when the meniscus flow velocity is high as is observed in high-speed casting, entrainment of a powder present on the surface of the molten steel in the molten steel or an increase in a variation in molten steel surface level occurs. When the meniscus flow velocity is low, as is observed in low-speed casting, a deckel is formed on the surface of the molten steel, hindering the operation. Further, in this case, inclusions or Ar bubbles are trapped in solidified shell to deteriorate the quality of the cast slab in its portion very near the surface thereof. For this reason, the meniscus flow velocity should be kept on a constant level. Since it is difficult to attain such a flow pattern through the regulation of the nozzle shape and the nozzle depth from the molten steel surface, several methods for regulating the flow of a molten steel within a mold by taking advantage of a direct current magnetic field have been proposed in the art.

Japanese Examined Patent Publication (Kokoku) No. 2-20349 discloses a method Wherein the flow of a molten steel within a mold is regulated using a direct current magnetic field in this method, a direct current magnetic field is allowed to act on a part of a main passage of a molten steel stream delivered through a submerged nozzle to decelerate the main stream of the molten steel, thereby preventing the entry of a descending stream into a deep portion of a strand pool. At the same time, the main stream is divided into small screams to cause agitation of the molten steel within the pool. In this method, however, since a direct current magnetic field is allowed to act on a part of the width of the mold, a stream delivered through the nozzle, in some cases, bypasses a brake band (a magnetic field band). That is, a stream directed from a place, where the brake is weak, toward the lower part of the pool occurs. This brings inclusions into a deep portion of the pool. Further, in this case, since this phenomenon is not stable, the flow of the molten steel within the mold becomes unstable, resulting in unstable agitation at the upper part of the pool. For this reason, the above method could not improve the quality of the cast slab.

Japanese Unexamined Patent Publication (Kokai) No. 2-284750 discloses a method wherein a direct current magnetic field is applied to the whole region in the width direction of the mold. According to this method, although a stream below the brake band can be brought into plug flow, the direct current magnetic field is applied to a place where braking is applied. Further, the regulation of the meniscus flow velocity is carried out by applying a direct current magnetic field to the whole mold or alternatively by applying a direct current magnetic field in a two-stage manner. A method wherein a direct current magnetic field is applied to a portion below the nozzle hole is also disclosed therein. As described below, however, the meniscus flow velocity is influenced greatly by the angle of molten steel stream delivered through a nozzle, the position of the magnetic field, and the magnetic flux density, and, hence, even in this method, the flow of the molten steel was unstable.

Thus, although the prior art discloses methods for bringing a stream below a brake band into plug flow, it does not disclose any method for regulating the meniscus flow velocity by different means depending upon the casting speed.

DISCLOSURE OF THE INVENTION

The present invention provides a method wherein the depth of the entry of a descending stream of a molten steel stream is decreased and, at the same time, particularly the meniscus flow velocity on the molten steel surface is regulated according to the casting speed, thereby providing a cast slab having a very excellent surface property unattainable by the above conventional methods.

Specifically, the present invention provides method for regulating the floor of a molten steel within a mold by taking advantage of a direct current magnetic field, comprising the step of carrying out continuous casting while regulating the flow of a molten steel by applying a direct current magnetic field having a substantially uniform magnetic flux density distribution over the whole width direction of the mold, characterized in that the flow velocity of a meniscus on the surface of the molten steel within the mold is regulated in a range of from 0.20 to 0.40 m/sec while applying a magnetic field. When the flow velocity of the meniscus on the surface of the molten steel is significantly increased, the molten steel delivery angle of the nozzle and the position of the magnetic field are determined so that a stream of the molten steel delivered through the nozzle does not traverse a magnetic field zone but collides directly with a short-side wall of the mold and the magnetic flux density B is then regulated according to the following equation (1), thereby regulating the meniscus flow velocity in the above specified range.

$$V_P/V_O=1+\alpha_1\{(1-\exp(-\beta_1\cdot H^2)\} \quad (1)$$

wherein $H=185.8\cdot B^2\cdot D\cdot T/(D+T)V$ wherein $V_P$ represents the meniscus flow velocity when a magnetic field is applied, m/sec;

$V_O$ represents the meniscus flow velocity when no magnetic field is applied, m/sec;

B represents the magnetic flux density in the center in the direction of the height in the direct current magnetic field, T;

D represents the width of the mold, m;

T represents the thickness of the mold, m;

V represents the average flow velocity of the molten steel delivered though a nozzle hole, m/sec; and $\alpha_1$ and $\beta_1$ are constants.

In this case, $V_O$ is a measured value and D, T, and V are predetermined values. Therefore, the meniscus flow velocity $V_p$ may be regulated by regulating the magnetic flux density B.

When the Meniscus flaw velocity is increased or decreased, the molten steel delivery angle of the nozzle and the position of the magnetic field are determined so that a stream of the molten steel delivered through the nozzle traverses a magnetic field zone and then collides with a short-side wall of the mold and the magnetic flux density is then regulated according to the following equation (2), thereby regulating the meniscus flow velocity to the above specified range:

$$V_F/V_O=1+\alpha_2\{\sin(\beta_2\cdot H)\exp(-r\cdot H)\} \quad (2)$$

wherein $H=185.8\cdot B^2\cdot D\cdot T/(D+T)V$ wherein $\alpha_2$, $\beta_2$, and $\gamma$ are constants.

According to the present invention, since the meniscus flow velocity is regulated by the above method, the flow of the molten steel within the mold can be properly regulated according to the casting speed, enabling the deterioration of the quality of the surface layer in a cast slab, caused by inclusions and Ar bubbles, to be surely prevented.

BRIEF DESCRIPTION OF THE DRAWINGS

FIG. 6 (B) is a schematic diagram showing the traverse of a magnetic field zone by a molten steel stream, delivered through a nozzle, followed by the collision of the molten steel stream against a short-side wall of a mold;

FIG. 14 is a listing of reference numeral of drawings.

BEST MODE FOR CARRYING OUT THE INVENTION

The best mode for carrying out the invention will now be described.

Continuous casting can be classified roughly into three systems, i.e., low-speed casting medium high speed casting, and high-speed casting, according to the casting speed.

In a low-speed casting process, casting of a thick material is carried out at a rate of less than about 0.8 m/min using a vertical casting machine.

In a medium-speed casting process, casting is carried out at a rate of about 0.8 to less than 1.8 m/min using a bending type continuous casting machine, a vertical bending type continuous casting machine or the like, and, in a high speed casting process, a thin material is cast at a rate of about 1.8 to less than 3 m/min using a vertical bending type continuous casting machine or the like.

Thus, a considerable difference in casting speed is found among casting processes, resulting in a variation in meniscus flow velocity on the surface of a molten steel according to casting conditions (casting speed, size of cast slab and the like).

As described above, when the meniscus flow velocity is high, the variation in molten steel level becomes so large that a powder present on the surface of the molten steel is entrained in the molten steel, while when the meniscus flow velocity is low, inclusions of Ar bubbles are trapped in a solidified shell. In both the cases, the surface quality of the resultant cast slab is deteriorated.

Therefore, mere regulation of the meniscus flow velocity cannot provide a cast slab having an excellent surface quality.

Figure 1:
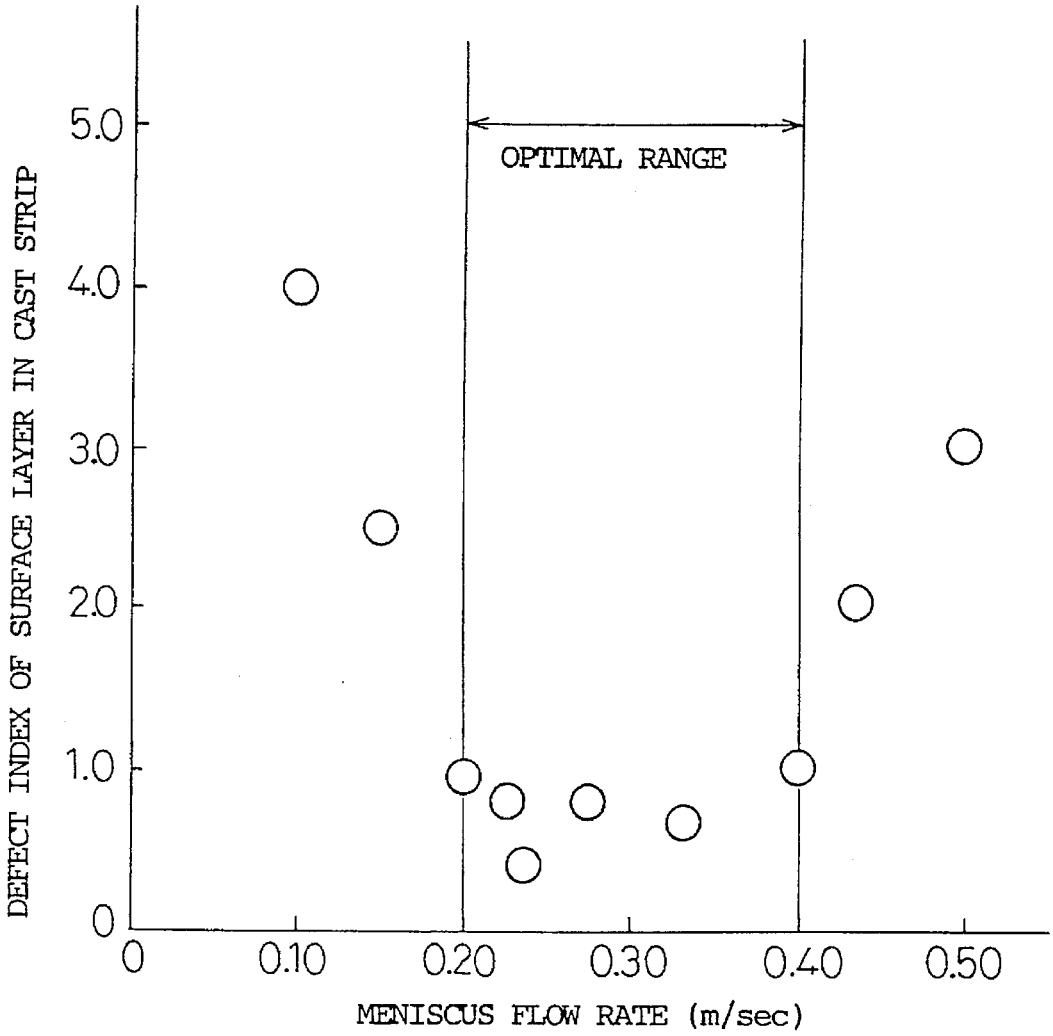
FIG. 1 is a diagram showing a relationship between the meniscus flow velocity and the index of defects in the surface layer of a cast slab which indicates the optimal meniscus flow velocity of the present invention.

Based on the above recognition, the present inventors have made studies on an optimal meniscus flow velocity range. Specifically, casting was carried out using an actual continuous casting machine under various casting conditions to investigate the relationship between the meniscus flow velocity and the defect in a cast slab. As a result, it has beer found that, when the meniscus flow velocity is in the range of 0.20 to 0.40 m/sec, the defect of the cast slab can be significantly reduced. The results are shown in FIG. 1. As can be seen from the drawing, when the meniscus flow velocity is in the range of from 0.20 to 0.40 m/sec, the index of defects in the surface of cast slabs is not more than 1.0, indicating that a meniscus flow velocity in this range can offer improved surface quality.

Means for providing a meniscus flow velocity in the above range will now be described.

The present Inventors have made a model experiment using mercury in equipment corresponding to a scale of about ½ of an actual machine to elucidate the influence of the angle of a molten steel delivered through a nozzle, the position of a magnetic field, and the magnetic flux density.

Figure 2:
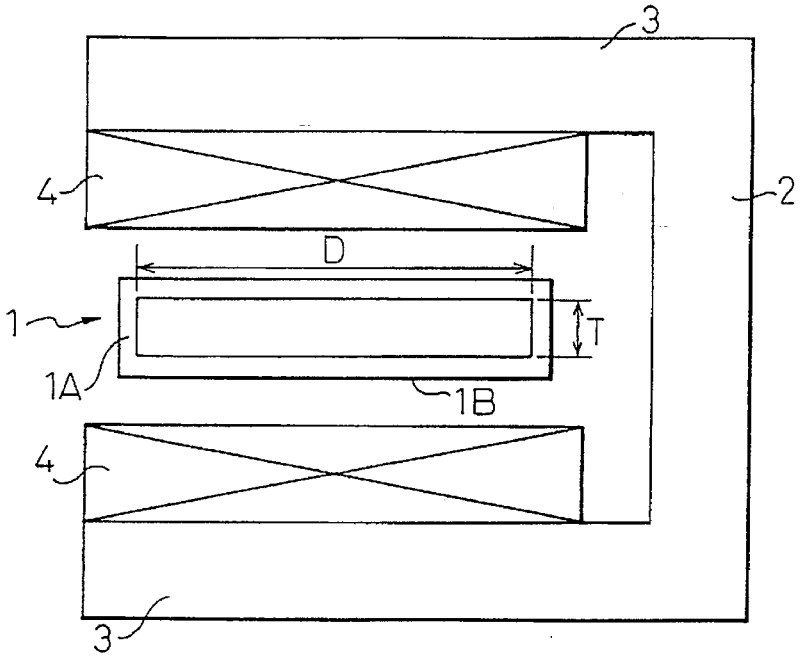
FIG. 2 is a schematic plan view of a magnetic field coil for generating a direct current magnetic field.

At the outset, a direct current magnetic field was formed, for example, by, as shown in FIG. 2, providing a pair of coils 4, 4 on opposed legs 3, 3 of a ⊃-shaped iron core 2 and passing a direct current through the coils 4, 4. In this case, a direct current magnetic field having magnetic flux density, which is uniform in the width reaction, could be provided by using a magnetic pole having a width larger than the width of the mold.

Then, this direct current magnetic field was used to determine conditions for bringing a molten steel stream below the magnetic field zone applied to the molten steel into plug flow. Plug flow refers to the molten steel moving or flowing like a solid (at very low shearing stresses).

Basically, a higher magnetic flux density facilitates plug flowing. The present inventors have defined the minimum required magnetic flux density depending upon the amount of the poured molten steel by the following parameter H:

$$H=185.8\cdot B^2\cdot D\cdot T/(D+T)V$$

wherein

B represents the magnetic flux density in the center in the direction of the height in the direct current magnetic field, D represents the width of the mold, T represents the thickness of the mold, and V represents the average flow velocity of the molten steel delivered through a nozzle hole.

The parameter represents the ratio of the electromagnetic force acting on the molten steel, due to the direct current magnetic field, to the inertial force of the molten steel stream delivered through the nozzle. The larger the B value and the smaller the V value, the larger the H value. The relationship between the parameter H and the flow velocity of a descending stream in the vicinity of a short-side wall of a mold below the magnetic field was investigated in order to provide conditions for bringing the molten steel stream into plug flow. As a result, it has been found that, as shown in FIG. 3, the stream below the magnetic field zone can be brought into plug flow by bringing the H value to not less than 2.6 although the braking efficiency somewhat varies depending upon the molten steel delivery angle of the nozzle and the position of the magnetic field.

Figure 3:
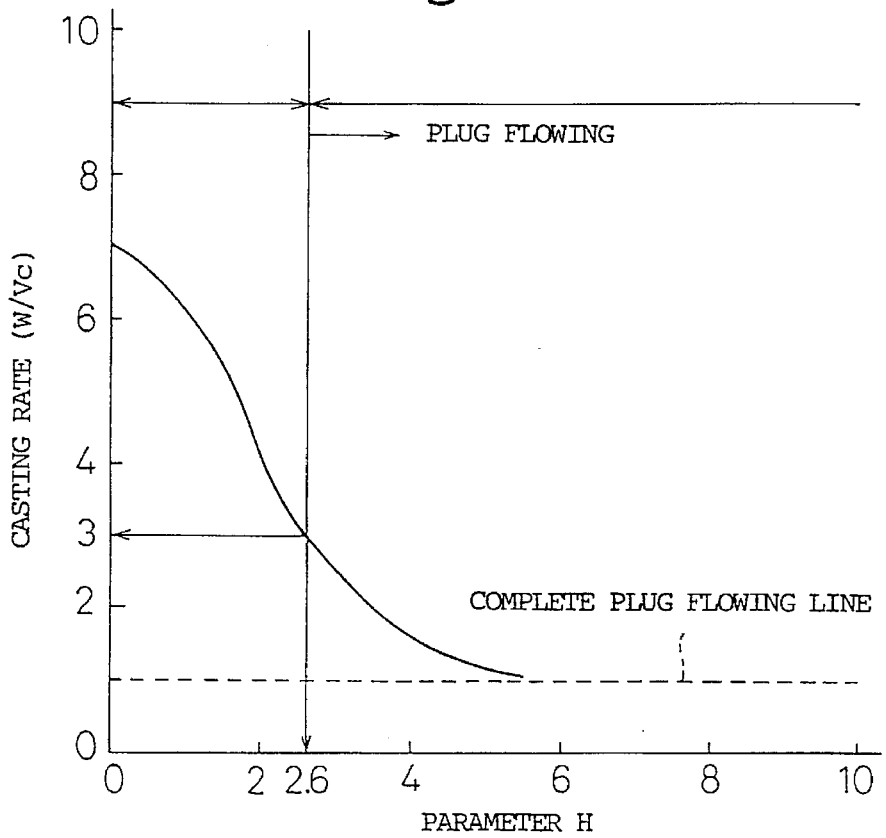
FIG. 3 is a diagram showing a relationship between the parameter H and the casting speed, which indicates a parameter H necessary for bringing a molten steel stream to plug flow.

In FIG. 3, the casting speed in continuous casting is plotted or the ordinate, W is the flow velocity of a descending stream, in the vicinity of a short-side wall, below the magnetic field zone, and $V_c$ is a value obtained by dividing the amount of the stream delivered through the nozzle by the horizontal sectional area of the pool.

Then, in order to learn what the meniscus flow velocity is, the present inventors have investigated the relationship between the meniscus flow velocity and the parameter H by varying the angle of a molten steel stream delivered through a nozzle, the position of a magnetic field, and the flow velocity of the molten steel with a direct current magnetic field applied. As a result, it has been found that there is a clear relationship between the parameter H and the ratio of the meniscus flow velocity $V_p$ in the case where a magnetic field is applied, to the meniscus flow velocity Vo in the case where no magnetic field is applied, i.e., Vp/Vo, and that two tendencies are found in the above relationship.

Figure 4:
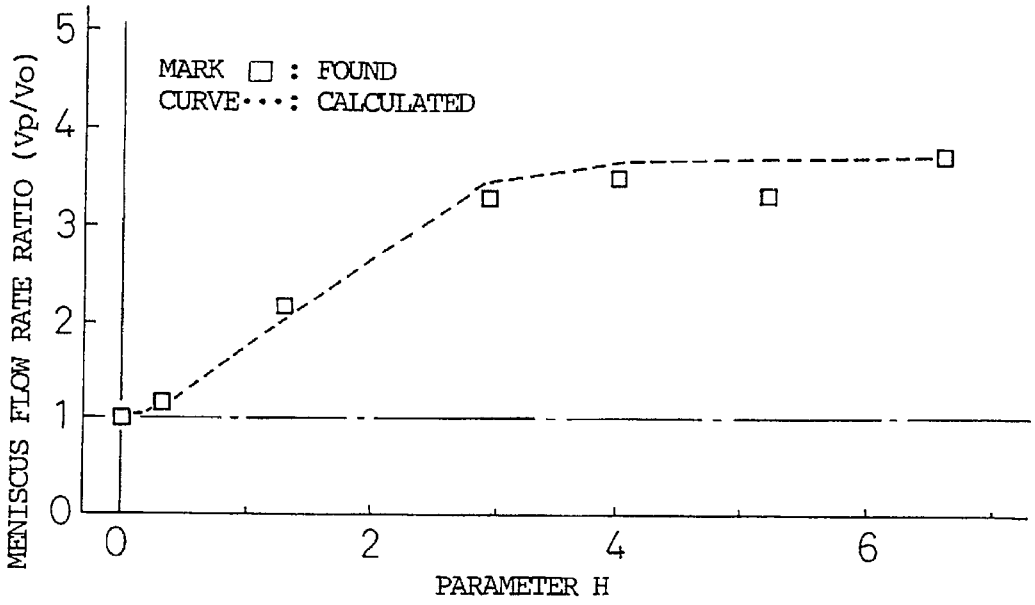
FIG. 4 is a diagram showing a relationship between are parameter H and the meniscus flow velocity an embodiment where a stream of a molten steel delivered through a nozzle collides directly against a short-side wall of a mold.

Specifically, one of tendencies is that, as shown in FIG. 4, an increase in parameter H results only in an increase in meniscus flow velocity. The other tendency is that, as shown in FIG. 5, when the parameter H is increased, the meniscus flow velocity is first increases and then decreases.

Further, it has been found that these two tendencies depend upon whether or not a molten steel stream delivered through the nozzle traverses a region having the highest magnetic flux density in a magnetic field zone when it collides with a short-side wall of the mold.

Figure 6A:
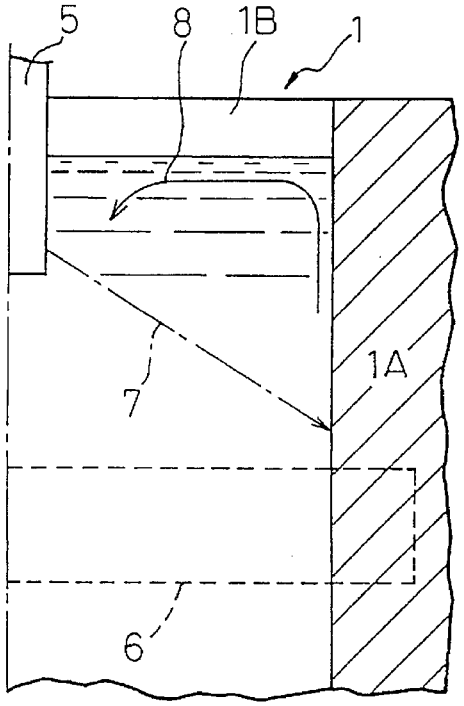
FIG. 6 (A) is a schematic diagram showing the collision of a molten steel stream, delivered through a nozzle, directly against a short-side wall of a mold.

As shown in FIG. 6 (A), when a molten steel stream 7 delivered through a nozzle 5 in a mold 1 collides against a short-side wall 1A in the mold before it traverses a magnetic field zone 6, the meniscus flow velocity ratio Vp/Vo of a meniscus flow 8 has a tendency as shown in FIG. 4.

Figure 5:
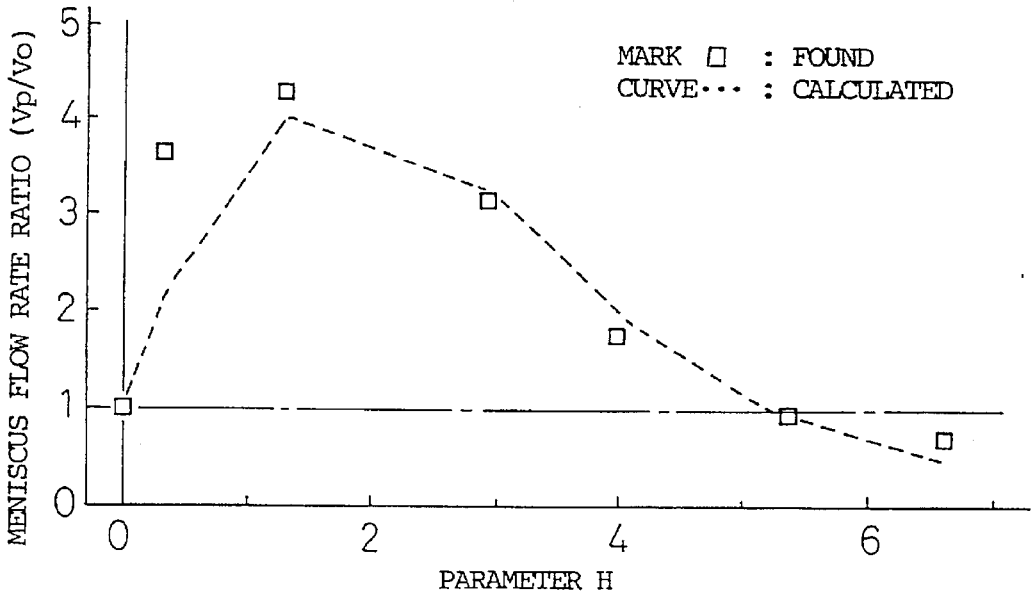
FIG. 5 is a diagram showing a relationship between the parameter H and the meniscus flow velocity in an embodiment where a stream of a molten steel delivered through a nozzle traverses a magnetic field zone and then collides against a short-side wall of a mold.
Figure 6B:
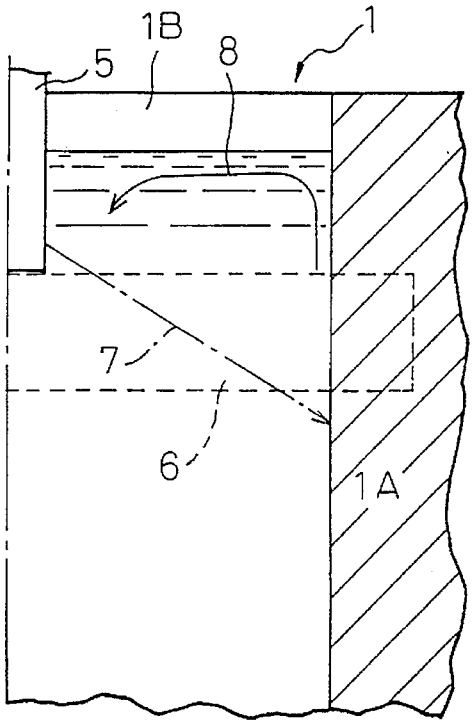
Figure 7A:
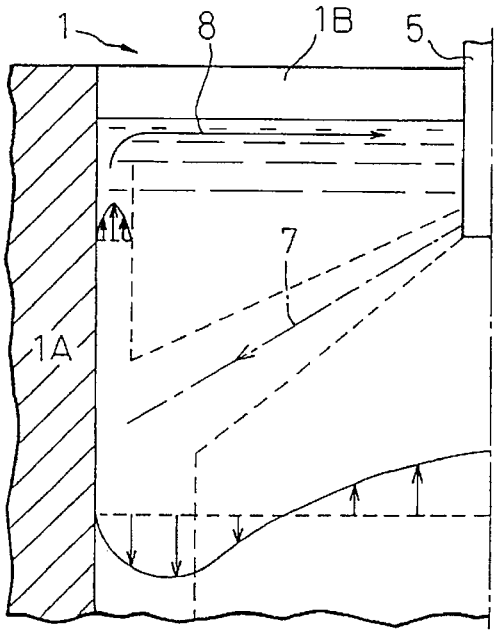
FIGS. 7 (A) to 7 (D) are a typical diagram showing a relationship between a molten steel stream, delivered through a nozzle, and a magnetic field zone.
Figure 7B:
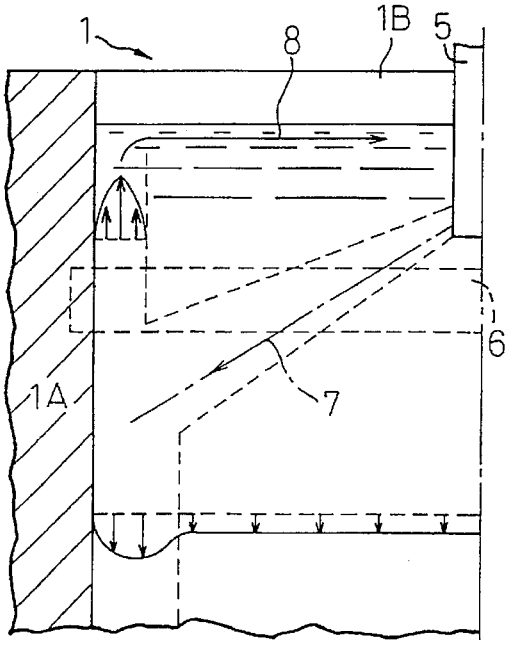
Figure 7C:
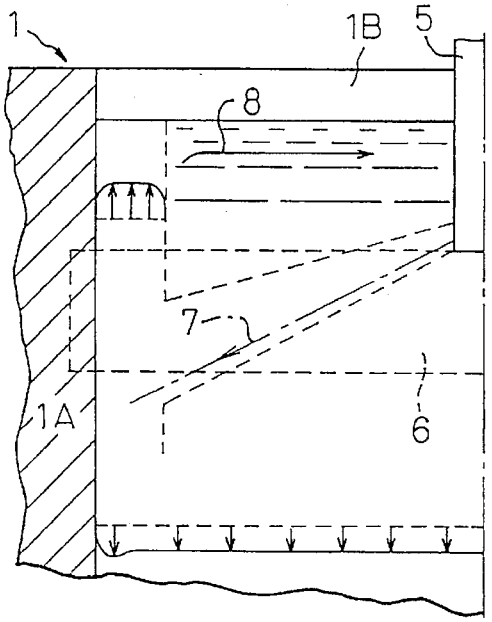
Figure 7D:
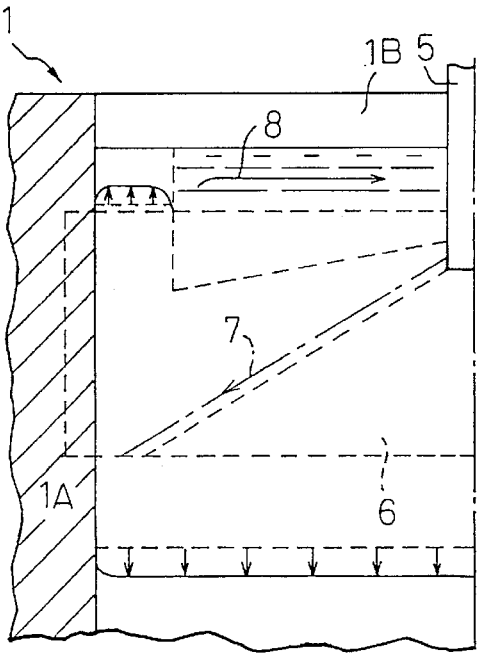

On the other hand, as shown in FIG. 6(B), when the molten steel stream 7 delivered through the nozzle 5 in the mold 1 traverses the magnetic field zone 6 and then collides against the short-side wall 1A of the wall, the meniscus flow velocity ratio has a tendency as shown in FIG. 5.

From the above results, the following facts have been found. In an embodiment shown FIG. 6 (A), when the parameter H is not less than 0.3, the meniscus flow velocity Vp is clearly higher than the meniscus flow velocity Vo. On the other hand, in an embodiment shown in FIG. 6 (B), when the parameter H is less than 5.3, the meniscus flow velocity Vp is higher than the meniscus flow velocity Vo, while when the parameter His not less than 5.3, the meniscus flow velocity Vp becomes lower than the meniscus flow velocity Vo.

In other words, it is apparent that the regulation of the position for delivering a molten steel through a nozzle, the angle of the molten steel stream delivered through the nozzle, the position of a magnetic field zone and the like are important to the regulation of the meniscus flow velocity.

In order to regulate the meniscus flow velocity so as to fall within the above optimal range, it is necessary to determine how nozzle conditions and magnetic field conditions are set with respect to the meniscus flow velocity Vo in the case where no magnetic field is applied. This can be achieved by determining the relationship between the parameter H and the ratio of the meniscus flow flow velocity Vp, in the case where a magnetic field is applied, to the meniscus flow velocity Vo, in the case where no magnetic field is applied, i.e., Vp/Vo. In this case, as described above, the controllability of the meniscus flow velocity varies greatly depending upon whether or not the molten steel stream delivered through the nozzle directly traverses the magnetic field. Therefore, studies should be carried out on two cases.

First, when a molten steel stream delivered through a nozzle is collided against a short-side wall of a wall before it traverses a magnetic field zone, as can be seen from FIG. 4, the meniscus flow velocity increases with increasing the parameter H. Therefore, the Vp/Vo value is an increasing function of the parameter H. Good agreement with experimental results can be attained, for example, when following equation (1) is used in the function:

$$V_p/V_o=1+\alpha_1\{1-\exp(-\beta_1\cdot H^2)\} \quad (1)$$

In this experiment, $\alpha_1=2.6$ and $\beta_1=0.3$ were used as constant values.

On the other hand, when the molten steel stream delivered through the nozzle directly traverses the magnetic field zone, as can be seen from FIG. 5, the meniscus flow velocity first increases and then decreases with increasing the parameter H. Therefore, a function which first increases and then decreases with increasing the parameter H may be used in Vp/Vo. Good agreement with experimental results can be attained, for example, when following equation (2) is used in the function:

$$V_p/V_o=1+\alpha_2\{\sin(\beta_2\cdot H)\exp(-r\cdot H)\} \quad (2)$$

In this experiment, $\alpha_2=6.5$, $\beta_2=0.63$, and $\gamma=0.35$ were used as constant values.

The equation of parameter H is substituted for H in the equation 2 to determine the meniscus flow velocity $V_p$, and the magnetic flux density B is regulated to regulate the meniscus flow velocity Vp so as to fall within the range shown in FIG. 1.

The method for regulating the meniscus flow velocity will now be described in more detail.

At the outset, the meniscus flow velocity Vo, in the case where no magnetic field is applied, is measured. In this case, for example, a metal rod is immersed in a molten steel, the load applied to the metal rod is measured with a strain gauge, and the load is converted to flow velocity to determine a desired flow velocity.

Then, in the ease of application of a magnetic field the meniscus flow velocity ratio Vp/Vo for bringing the meniscus flow velocity $V_P$ to the range of from 0.20 to 0.40 m/sec is determined. In this case, the target range (0.20 to 0.40 m/sec) may be previously divided by the meniscus flow velocity in the case where no magnetic field is applied. When the resultant value exceeds 1, the meniscus flow velocity should be increased in the casting operation. In this case, the equation (1) may be used Alternatively, among parameter H values of less than 5.3, a parameter H for providing the predetermined $V_P/V_O$ value, that is, magnetic flux density B, may be determined using the equation (2). Which equation, the equation (1) or the equation (2), should be used depends upon the Vo value. Specifically, when the meniscus flow velocity is small, the equation (1) is used because the degree of increase in the flow velocity is large. On the other hand, when the degree of increase in flow velocity is small, the equation (2) is used in such a region where the meniscus flow velocity is once increased and then decreased. When Vp/Vo is less than 1, among parameter H values of not less than 5.3, a parameter H for providing the predetermined Vp/Vo value, that is, magnetic flux density B, may be determined using the equation (2).

Thus, the application of a direct current magnetic field having a magnetic flux density distribution, which is substantially uniform in the width direction of the mold in the direction of thickness, enables the meniscus flow velocity to be regulated to the optimal range while bringing the molten steel stream below the magnetic field zone into plug flow.

The phenomenon wherein the meniscus flow velocity is once increased and then decreased can be explained as follows. In a mold, the flow velocity of a meniscus stream 8 and the depth of entry of a molten steel stream 7 delivered through a nozzle are determined by the distribution of the molten steel stream delivered through the nozzle in the case where the stream 7 delivered through a nozzle collides against a short-side wall 1A with gradual spreading and is then distributed upward or downward (see FIG. 7 (A)). In the method of the present invention, when a direct current magnetic field 6, which is substantially uniform in the width direction, is applied in the vicinity of a nozzle hole, the entry of a molten steel stream delivered through a nozzle into a lower portion of the pool is first inhibited by an electromagnetic brake. This makes the upward flow of the molten steel larger than the flow of the molten steel directed to the magnetic field zone 6, accelerating the flow in the meniscus (see FIG. 7 (B)). A subsequent increase in magnetic flux density makes the flow of the molten steel within the magnetic field zone 6 uniform, which brings the molten steel stream below the magnetic field zone 6 into plug flow (see FIG. 7 (C)). When the magnetic flux density is further increased, a region having a high magnetic flux density approaches the molten steel surface. In this case, as in the ease where the molten steel stream below the magnetic field zone is brought into plug flow, a flow which rises along the short-side wall is braked. Therefore, at a certain or higher magnetic flux density, the meniscus flow velocity can be made lower than that in the case where no magnetic field is applied (see FIG. 7 (D)).

EXAMPLES

A molten low-carton aluminum killed steel (AISI: A569–72) was poured into a mold having a size in the direction of internal width (D) of 1 to 2 m and a size in the direction of internal thickness (T) of 0.2 to 0.25 m, and casting was carried out under conditions specified in Table 1 with the average flow velocity (V) of the molten steel delivered through a nozzle being varied in a range of from 0.2 to 1.3 m/sec depending upon the casting speed.

A magnetic coil was provided on the outer periphery of the the mold while taking into consideration the casting speed so that a direct current magnetic field could be uniformly applied in the width direction of the mold. Conditions for each casting speed were as follows.

(1) Low-speed casting process

Regarding common conditions, the meniscus flow velocity $V_O$ in the case where no magnetic field was applied was 7 cm/sec, and the magnetic flux density B for providing parameter H of not less than 2.6 was 0.15 T (tesla).

In this embodiment, the meniscus flow velocity is so low that the degree of acceleration should be large. Therefore, casting was carried out under such a condition that the meniscus flow velocity increases with increasing the magnetic flux density. That is, the molten steel delivery angle of the nozzle and the position of the magnetic field were adjusted so that a stream of the molten steel, delivered through the nozzle, did not directly traverse a high magnetic flux zone, and the H value for bringing the meniscus flow velocity to the range of from 0.20 to 0.23 m/sec was determined using the equation (1).

Specifically, in the case of casting speed of 0.3 m/min, the magnetic flux density to applied to the mold, that is, the magnetic flux density B necessary for increasing the meniscus flow velocity $V_P$ to 0.22 m/sec is as follows. From the equation (1), $$V_P/V_O=0.22/0.7=1+2.2\{1-\exp(-0.4\times H^2)\}.$$

Therefore, $$H=4.3=185.8\times B^2\times 1.5\times 0.25/(1.5+0.25)\times 0.27.$$

From this,

B=0.17 T.

In this case, $\alpha_1$ was 2.2, and $\beta_1$ was 0.4 with the other conditions being as given in Table 1.

Similarly, in the case of a casting speed of 0.4 m/min, the magnetic flux density was 0.16 T, and the parameter H 3.2.

Further, in the case of a casting speed of 0.5 m/min, the magnetic flux density was 0.16 T, and the parameter was 2.6.

Cast slabs prepared under the above casting conditions were investigated for defects in the surface layer and interior thereof. The results are tabulated in Table 1 and shown in FIGS. 8 and 9.

Figure 8:
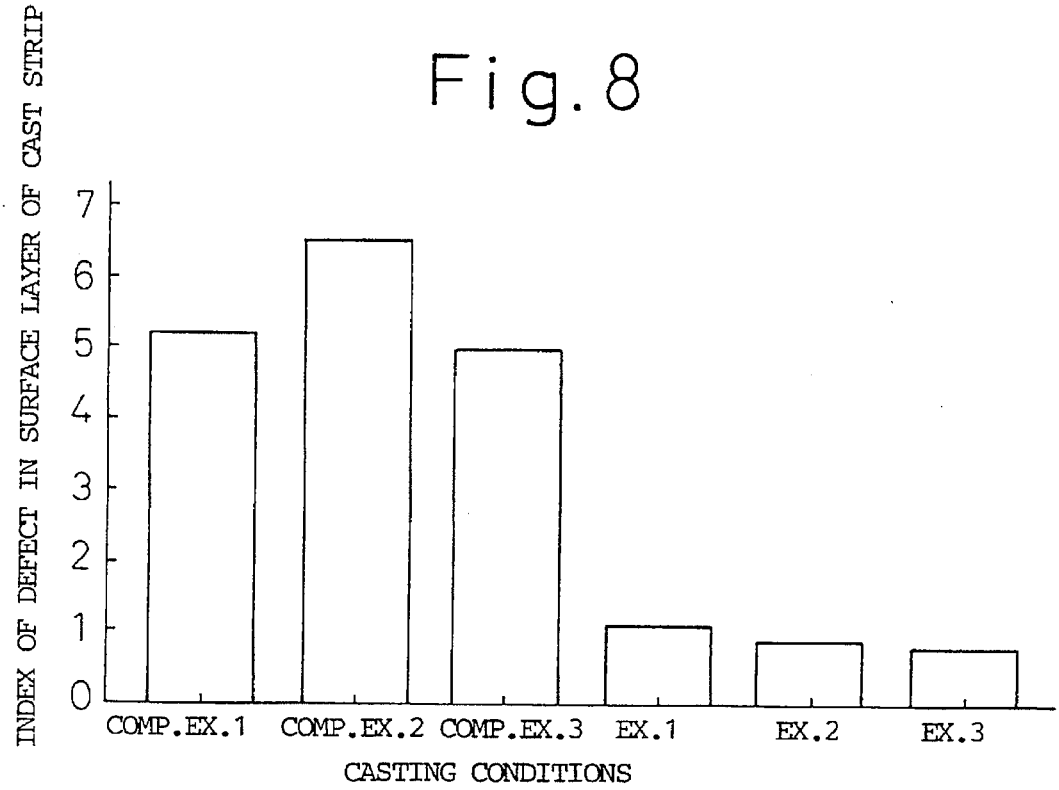
FIG. 8 is a diagram showing an index of defect in the surface layer of case slabs prepared in Examples 1 to 3 and Comparative Examples 1 to 3.
Figure 9:
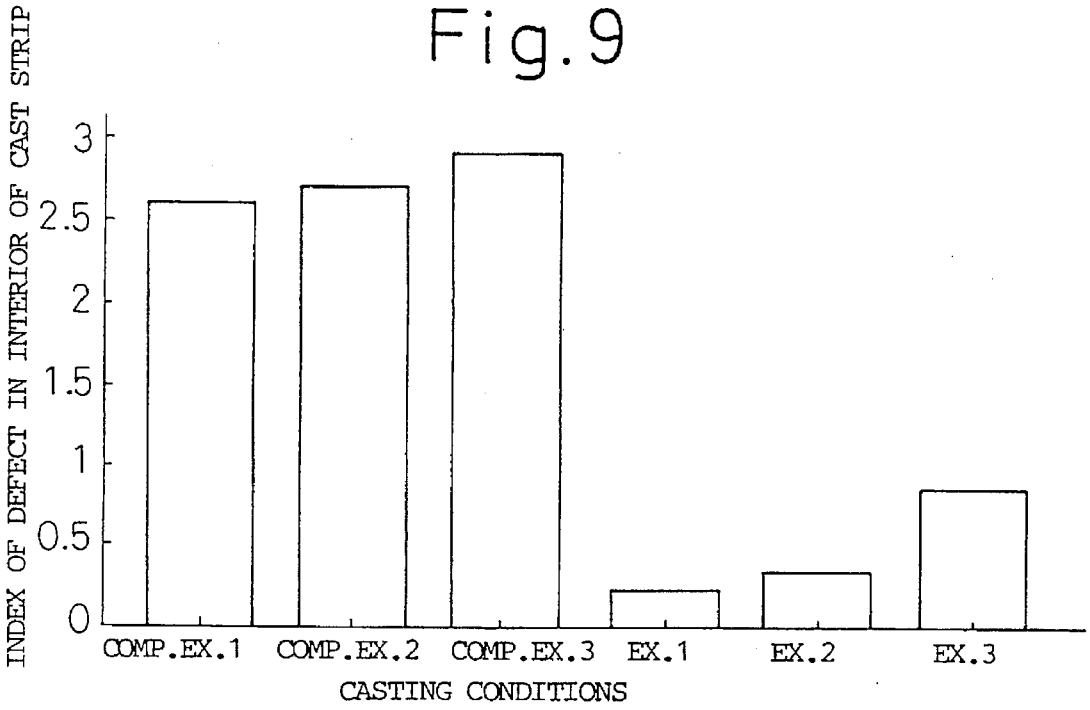
FIG. 9 is a diagram showing at index of defects in the interior of cast slabs prepared in Examples 1 to 3 and Comparative Examples 1 to 3.

For comparison, the results of investigation for defects in the surface layer and interior of cast slabs prepared under the same casting conditions except that no magnetic field was applied (1 and 2) and a nonuniform magnetic field was applied in the width direction of the mold (3) (in such a manner that a direct current magnetic field was applied in the direction of the thickness under such a condition as will provide a magnetic flux density of 0.3 T using an iron core, having coil height of 370 mm and a thickness of 370 mm, provided on a part of the width direction of the mold with the direction of the direct current magnetic field being laterally inverted) are tabulated in Table 1 and shown in FIGS. 8 and 9.

As is apparent from the above table and drawings, according to the examples of the present invention, washing at the front face of a solidified shell based on the acceleration of meniscus flow velocity could prevent the trapping of inclusions in the surface layer of the cast slab, resulting in significantly reduced internal defect index and inclusion defect index in the surface layer as compared with those in comparative examples.

(2) Medium-speed casting process

Regarding common conditions, the meniscus flow velocity $V_O$ was 0.12 m/sec, and the magnetic flux density B for providing a parameter H of not less than 2.6 was 0.18 T.

Although the meniscus flow velocity in this embodiment is higher than that in the low-speed casting process, the meniscus flow velocity should be further increased. Therefore, casting was carried out under such a condition that, in increasing the magnetic flux density, the meniscus flow velocity was first increased and, thereafter, decreased. The molten steel delivery angle of the nozzle and the position of the magnetic field were adjusted so that a streak of the molten steel, delivered through the nozzle, directly traverses a magnetic flux zone. Further, the equation (2), which is an equation applied to the case where the H is between a value which provides the maximum meniscus flow velocity and a value which provides a meniscus flow velocity identical to the case wherein no magnetic field is applied, that is, 5.3, was used to determine H (B) for bringing the meniscus flow velocity $V_p$ to 0.31 m/sec.

Specifically, in the case of casting speed of 0.8 m/min, the magnetic flux density B to be applied to the mold is as follows. From the equation to (2)

$$V_P/V_O=0.31/0.12=1+5.5\{\sin(0.6\times H)\exp(-0.3\times H)$$

Therefore, $$H=3.5=185.8\times B^2\times 1.5\times 0.25/(1.5+0.25)\times 0.52.$$

From this,

B=0.21 T.

In this case, $\alpha_2$ was 5.5, $\beta_2$ was 0.6, and $\gamma$ was 0.3 with the other conditions being as given in Table 1.

Similarly, in the case of a casting speed of 1.0 m/min and 1.2 m/min, the magnetic flux densities were respectively 0.28 T and 0.34 T, and the parameters H were respectively 4.1 and 4.7.

Cast slabs prepared under the above casting conditions were investigated for defects in the surface layer and interior thereof. The results are tabulated in Table 1 and shown in FIGS. 10 and 11.

Figure 10:
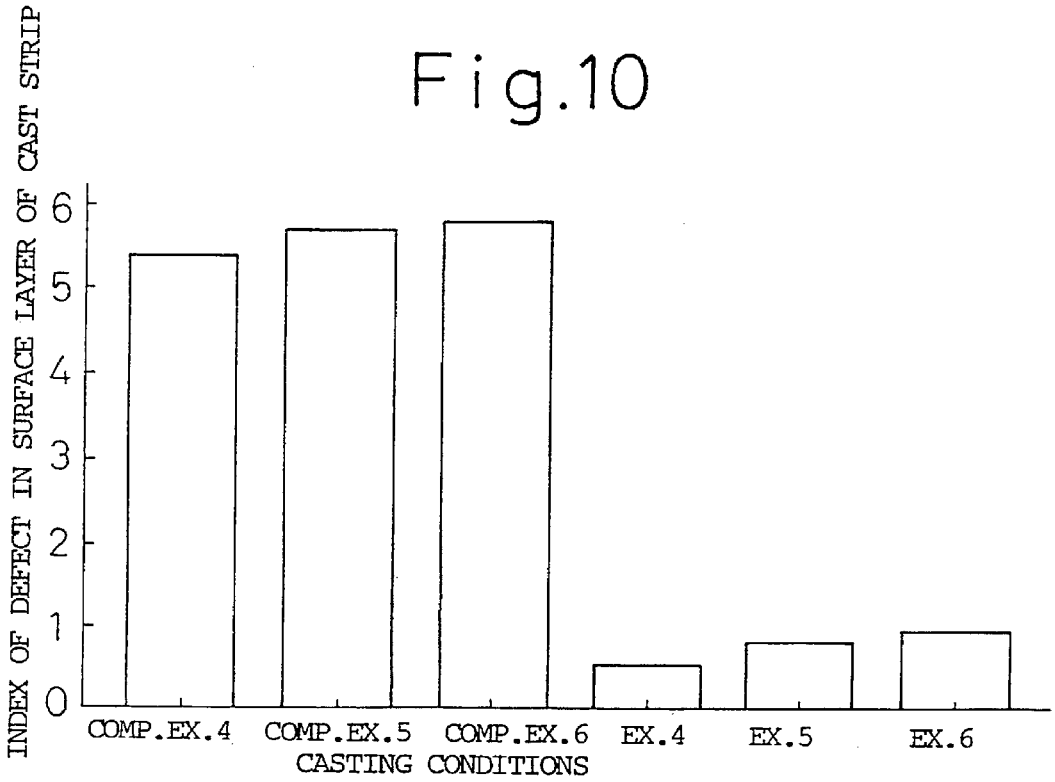
FIG. 10 is a diagram showing an index of defects in the surface layer of cast slabs prepared in Examples 4 to 6 and Comparative Examples 4 to 6.
Figure 11:
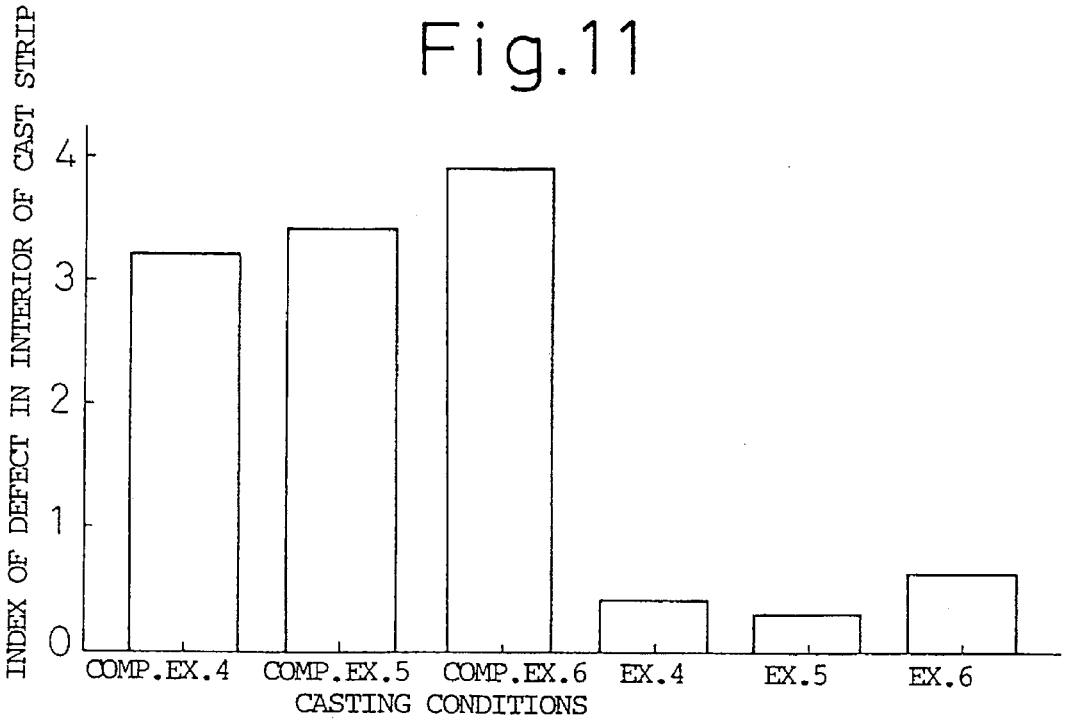
FIG. 11 is a diagram showing an index of defects in the interior of cast slabs prepared in Examples 4 to 6 and Comparative Examples 4 to 6.

For comparison, the results of an investigation for defects in the surface layer and interior of cast slabs prepared under the same casting conditions except that no magnetic field was applied (4), on a nonuniform magnetic field was applied in the width direction of the mold (5 and 6), are tabulated in Table 1 and shown in FIGS. 10 and 11.

As is apparent from the above table and drawings, according to the examples of the present invention, as in the case of the low-speed casting process, the surface layer defect and the internal defect of the cast slat could be significantly reduced as compared with those in comparative examples.

(3) High-speed casting process

Regarding common conditions, the meniscus flow velocity $V_O$ was 0.50 m/sec, and the magnetic flux density B for providing a parameter H of not less than 2.6 was 0.29 T.

Since the meniscus flow velocity in this embodiment is high, it should be decreased. Therefore, the molten steel delivery angle of the nozzle and the position the magnetic field were adjusted so as for a stream of the molten steel, delivered through the nozzle, directly traversed a magnetic flux zone, and the equation (2) was used to determined H(B) necessary for bringing the meniscus flow velocity $V_p$ to 0.37 m/sec.

Specifically, in the case of a casting speed of 2.0 m/min, the magnetic flux density B to be applied to the mold is as follows. From the equation (2), $$V_P/V_O=0.37/0.50=1+5.5\{\sin(0.6\times H)\exp(-0.3\times H)\}$$

Therefore, $$H=5.6=185.8\times B^2\times 1.1\times 0.25/(1.1+0.25)\times 1.19.$$

From this,

B=0.42 T.

In this case, $\alpha_2$ was 5.5, $\beta_2$ was 0.6, and $\gamma$ was 0.3 with the other conditions being as given in Table 1.

Similarly, in the case of a casting speed of 2.3 m/min and 1.8 m/min, the magnetic flux densities were respectively 0.44 T and 0.43 T, and the parameters H were respectively 5.8 and 6.0.

Cast slabs prepared under the above casting conditions were investigated for defects in the surface layer and interior thereof. The results are tabulated in Table 1 and shown in FIGS. 12 and 13.

Figure 12:
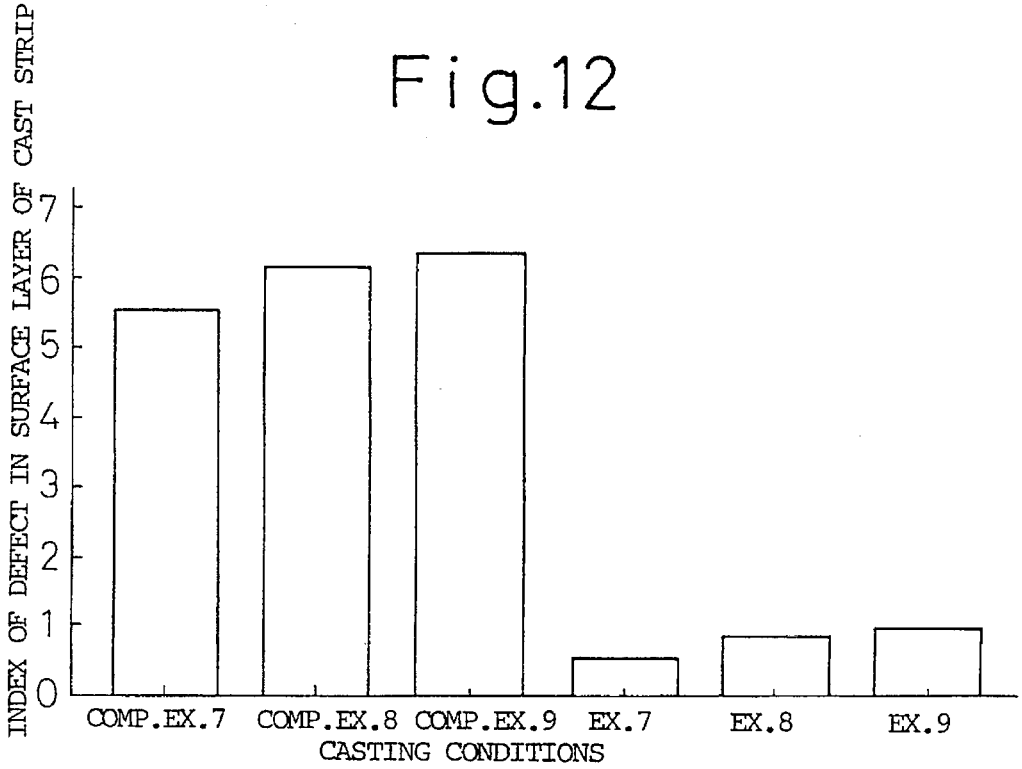
FIG. 12 in a diagram showing an index of defects in the surface layer of cast slabs prepared in Examples 7 to 9 and Comparative Examples 7 to 9.
Figure 13:
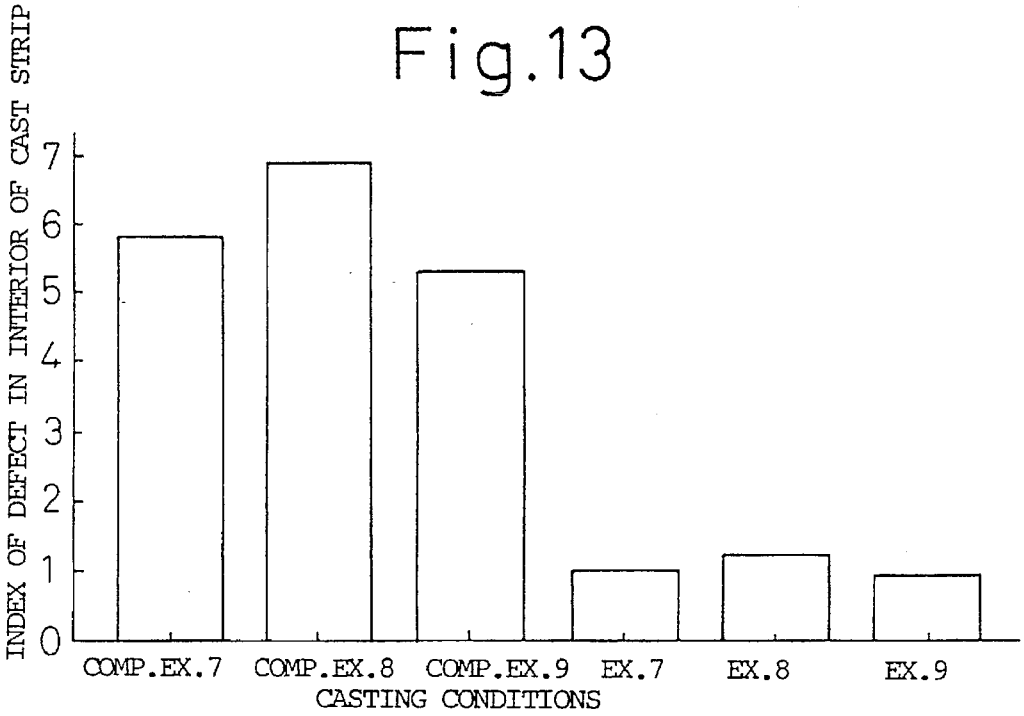
FIG. 13 is a diagram showing at index of defects in the interior of cast slabs prepared in Examples 7 to 9 and Comparative Examples 7 to 9.

For comparison, the results of an investigation for defects in the surface layer and interior of cast slabs prepared under the same casting conditions except that no magnetic field was applied (9), or a nonuniform magnetic field was applied in the width direction of the mold (7 and 8), are tabulated in Table 1 and shown in FIGS. 12 and 13.

As is apparent from the above table and drawings, as compared with the comparative examples, the examples of the present invention could significantly reduce the number of inclusion defects, in the surface of the cast slab, caused by powder entrainment and, further, could reduce a variation in the molten steel surface level, resulting in improved surface appearance. Further, at the same time, a stream of the molten steel below the magnetic field zone could be brought to plug flow, resulting in significantly reduced amount of internal defects in the cast slab.

TABLE 1

| | | | | Examples | | | | | | Comparative Examples | | |
|---|---|---|---|---|---|---|---|---|---|---|---|---|
| Casting process | Casting rate (m/min) | Width of cast slab (m) | Thickness of cast slab (m) | Position of magnetic field zone | Parameter H | Flow velocity of stream delivered through nozzle, V (m/sec) | Meniscus flow velocity, Vp (m/sec) | Index of defect in surface layer of cast slab | Index of defect in interior of cast slab | Index of defect in surface layer of cast slab | Index of defect in interior of cast slab | Remarks |
| Low-speed casting | | | | | | | | | | | | |
| 1 | 0.3 | 1.5 | 0.25 | N | 4.3 | 0.27 | 0.22 | 1.1 | 0.2 | 5.2 | 2.6 | Magnetic Field not applied |
| 2 | 0.4 | 1.4 | 0.2 | N | 3.2 | 0.27 | 0.22 | 0.9 | 0.3 | 6.5 | 2.7 | Magnetic field not applied |
| 3 | 0.5 | 1.2 | 0.25 | N | 2.6 | 0.36 | 0.21 | 0.8 | 0.8 | 5.0 | 2.9 | Nonuniform magnetic field applied |
| Moderate high-speed casting | | | | | | | | | | | | |
| 4 | 0.8 | 1.5 | 0.25 | Y | 3.5 | 0.52 | 0.32 | 0.5 | 0.4 | 5.4 | 3.2 | Magnetic field not applied |
| 5 | 1.0 | 1.8 | 0.25 | Y | 4.1 | 0.78 | 0.24 | 0.8 | 0.3 | 5.7 | 3.4 | Nonuniform magnetic field applied |
| 6 | 1.2 | 2.0 | 0.2 | Y | 4.7 | 0.83 | 0.25 | 0.9 | 0.6 | 5.8 | 3.9 | Nonuniform magnetic field applied |
| High-speed casting | | | | | | | | | | | | |
| 7 | 2.0 | 1.1 | 0.25 | Y | 5.6 | 1.19 | 0.37 | 0.5 | 1.0 | 5.4 | 5.8 | Nonuniform magnetic field applied |
| 8 | 2.3 | 1.0 | 0.25 | Y | 5.6 | 1.25 | 0.33 | 0.8 | 1.2 | 5.7 | 6.9 | Nonuniform magnetic field applied |
| 9 | 1.8 | 1.2 | 0.25 | Y | 6.0 | 1.17 | 0.29 | 0.9 | 0.9 | 5.8 | 5.3 | Magnetic field not applied |

Note:
Regarding the position of magnetic field zone given in the table, "N" represents that the stream of a molten steel delivered through a nozzle does not directly traverse a region having a high magnetic flux density, and "Y" represents that the stream of a molten steel delivered through a nozzle directly traverses a region having a high magnetic flux density.

Industrial Applicability

As is apparent from the foregoing detailed description, according to the present invention, the meniscus flow velocity can be stably increased or decreased while bringing a molten steel stream below a magnetic field zone into plug flow according to need, enabling the meniscus flow velocity to be regulated so as to fall within a specific range (0.20 to 0.40 m/sec). This makes it possible to prepare a cast slab wherein the defects in the surface layer as well as in the interior thereof has been greatly reduced, that is, a cast slab having an improved quality. Even when the casting speed is required to be varied during casting, the present invention can flexibly cope with a change of casting conditions. Further, the molten steel stream below the magnetic field zone can be surely brought into plug flow, enabling different steels to be continuously cast without using any iron plate unlike the prior art. In addition, a deterioration in quality of the cast slab before and after varying the kind of the steel to be cast can be prevented.

Thus, the present invention is very useful in continuous casting.

We claim:

1. A method for regulating the flow of a molten steel within a mold by taking advantage of a direct current magnetic field, comprising the step of carrying out continuous casting while regulating the flow of a molten steel, delivered through a nozzle, by applying a direct current magnetic field having a substantially uniform magnetic flux density distribution over the whole width direction of the mold, characterized in that the molten steel delivery angle of the nozzle and the position of the magnetic field are determined so that a stream of the molten steel delivered through the nozzle does not traverse a magnetic field zone but collides directly with a short-side wall of the mold and the magnetic flux density B is then regulated according to the following equation (1), thereby regulating the meniscus flow velocity in a range of from 20 to 40 cm/sec:

$$V_p/V_o=1+\alpha_1\{1-\exp(-\beta_1\cdot H^2)\} \quad (1)$$

wherein $H=185.8\cdot B^2\cdot D\cdot T/(D+T)V$ wherein $V_p$ represents the meniscus flow velocity with a magnetic field is applied, m/sec;

$V_o$ represents the meniscus flow velocity when no magnetic field is applied, m/sec;

B represents the magnetic flux density in the center in the direction of the height in the direct current magnetic field, T;

D represents the width of the mold, m;

T represents the thickness of the mold, m;

V represents the average flow velocity of the molten steel delivered through a nozzle hold, m/sec; and $\alpha_1$ and $\beta_1$ are constants.

2. The method of according to claim 1, wherein the parameter H is regulated to not less than 2.6.

3. The method according to claim 1, wherein the meniscus flow velocity is regulated in a range of from 0.20 to 0.40 m/sec by regulating the position for delivering the molten steel through the nozzle, the position of the magnetic field, and the magnetic flux density.

4. A method for regulating the flow of a molten steel within a mold by taking advantage of a direct current magnetic field, comprising the step of carrying out continuous casting while regulating the flow of a molten steel, delivered through a nozzle, by applying a direct current magnetic field having a substantially uniform magnetic flux density distribution over the whole width direction of the mold, characterized in that the molten steel delivery angle of the nozzle and the position of the magnetic field are determined so that a stream of the molten steel delivered through the nozzle traverses a magnetic field zone and then collides with a short-side wall of the mold and the magnetic flux density is then regulated according to the following equation (2), thereby regulating the meniscus flow velocity in a range of from 0.2 to 0.40 m/sec.:

$$V_p/V_o=1+\alpha_2\{\sin(\beta_2\cdot H)\exp(-\gamma\cdot H)\} \quad (2)$$

wherein $H=185.8\cdot B^2\cdot D\cdot T/(D+T)V$ wherein $V_p$ represents the meniscus flow velocity with a magnetic field is applied, m/sec;

$V_o$ represents the meniscus flow velocity when no magnetic field is applied, m/sec;

B represents the magnetic flux density in the center in the direction of the height in the direct current magnetic field, T;

D represents the width of the mold, m;

T represents the thickness of the mold, m;

V represents the average flow velocity of the molten steel delivered through a nozzle hold, m/sec; and wherein $\alpha_2$, $\beta_2$, and, $\gamma$ are constants.

5. The method according to claim 4, wherein the parameter H is regulated to not less than 2.6.

6. The method according to claim 4, wherein the meniscus flow velocity is regulated in a range of from 0.20 to 0.40 m/sec by regulating the position for delivering the molten steel through the nozzle, the position of the magnetic field, and the magnetic flux density.

* * * * *